US010495433B1

(12) United States Patent
Langner

(10) Patent No.: US 10,495,433 B1
(45) Date of Patent: Dec. 3, 2019

(54) METHODS AND APPARATUS FOR DISARMING AN EXPLOSIVE DEVICE

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 0 days.

(21) Appl. No.: 15/888,014

(22) Filed: Feb. 3, 2018

(51) Int. Cl.

| | |
|---|---|
| ***F24D 5/04*** | (2006.01) |
| ***F41B 9/00*** | (2006.01) |
| ***F42D 5/04*** | (2006.01) |
| ***F42B 5/02*** | (2006.01) |

(52) U.S. Cl.
CPC ..... *F42D 5/04* (2013.01); *F41B 9/0046* (2013.01); *F42B 5/02* (2013.01)

(58) Field of Classification Search
CPC ..... F42B 33/062; F42B 33/06; F42B 33/00; F42B 12/02; F41B 9/0046; F41B 9/00; F42D 5/04
USPC ..... 86/50; 89/1.13, 27.11; 124/56, 63, 64, 124/65, 74
See application file for complete search history.

(56) References Cited

U.S. PATENT DOCUMENTS

| | | | | |
|---|---|---|---|---|
| 5,134,921 | A * | 8/1992 | Breed | F41A 23/06 86/50 |
| 5,136,920 | A * | 8/1992 | Breed | F41A 23/06 102/430 |
| 5,743,246 | A * | 4/1998 | Mattern | B09B 3/0058 124/56 |
| 8,915,004 | B1 * | 12/2014 | Langner | F42B 33/06 124/65 |
| 9,200,881 | B1 * | 12/2015 | Langner | F42B 33/06 |
| 9,322,625 | B1 * | 4/2016 | Langner | F42B 33/062 |
| 10,054,388 | B1 * | 8/2018 | Langner | F41B 9/0046 |
| 10,126,106 | B1 * | 11/2018 | Langner | F42D 1/043 |
| 2009/0178548 | A1 * | 7/2009 | Tyas | F41B 9/0046 86/50 |

* cited by examiner

*Primary Examiner* — Jonathan C Weber
(74) *Attorney, Agent, or Firm* — Letham Law Firm LLC; Lawrence Letham

(57) ABSTRACT

A disrupter for launching a combination of water and a projectile toward an explosive device to disable the explosive device. The position of the projectile in the barrel of the disrupter determines an exit velocity of the water and the projectile from the barrel of the disrupter.

15 Claims, 5 Drawing Sheets

METHODS AND APPARATUS FOR DISARMING AN EXPLOSIVE DEVICE

FIELD OF THE INVENTION

Embodiments of the present disclosure relate to disrupter cannons used to disable explosive devices.

BRIEF DESCRIPTION OF THE DRAWING

Embodiments of the present disclosure will now be further described with reference to the drawing, wherein like designations denote like elements, and.

DETAILED DESCRIPTION OF THE PREFERRED EMBODIMENTS

Disrupter cannons are used by military, bomb squad, and other emergency service personnel to destroy and/or disable explosive devices including improvised explosive devices ("IED"), bombs (e.g., pipe bombs, pressure cooker bombs), and ordinance.

Disrupter cannons may propel a projectile, water, or both a projectile and water toward an explosive device to impact (e.g., strike) the explosive device. Impact of the projectile with the explosive device may interfere with (e.g., damage, destroy) a portion of the explosive device to disable (e.g., destroy, render safe) the explosive device.

The temperature of a projectile when it hits an explosive device may be a factor in whether the projectile disables the explosive device without detonating the explosive device. Temperature of a projectile may be decreased by positioning water between the pyrotechnic (e.g., cartridge) that launches the projectile and the projectile while in the barrel of the disrupter cannon prior to launch. The water decreases (e.g., prevents) the rise in temperature due to friction between the projectile and the inner surface of the barrel of the disrupter cannon and/or the transfer of heat from the burning pyrotechnic to the projectile. A projectile that has a lower temperature at impact with an explosive device is less likely to detonate the explosive device.

The weight of a projectile and velocity of launch may be a factor in whether the projectile disables the explosive device without detonating the explosive device. A projectile with more mass may be launched at a lower velocity to provide the same momentum as a lighter projectile launched at a higher velocity. Launching at a lower velocity decreases the likelihood of detonating the explosive device. The velocity of launch of a projectile from a disrupter cannon is the velocity at which the projectile travels on exit (e.g., leaving) the muzzle (e.g., muzzle end portion) of the barrel of the cannon (e.g., muzzle velocity).

The material that forms the projectile may be a factor in whether the projectile disables the explosive device without detonating the explosive device. A projectile that produces (e.g., makes, emits) sparks (e.g., fiery particles) via contact with the inner surface of the barrel or on impact (e.g., contact) with the explosive device may increase the likelihood of detonation of the explosive device.

The shape of a projectile, in particular the shape of the front (e.g., nose) of the projectile may be a factor in whether the explosive device is disabled. Many explosive devices, such as pipe bombs, are formed of components that mechanically coupled to each other. The shape of the nose of a projectile may be a factor in whether the impact of the projectile decouples the components of the explosive device thereby disabling the explosive device.

Figure 1:
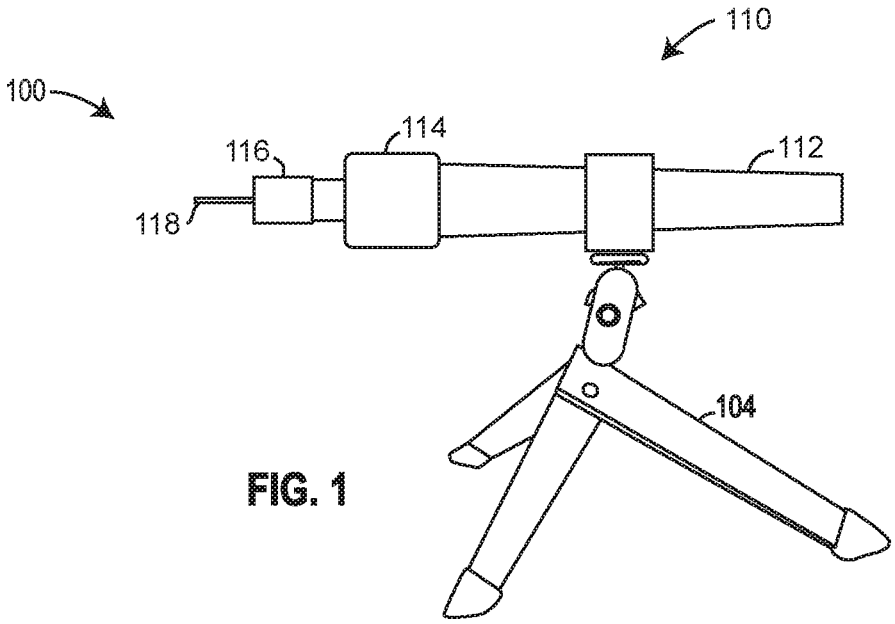
FIG. 1 is a view of a disrupter system prior to firing the disrupter cannon according to various aspects of the present disclosure.
Figure 2:
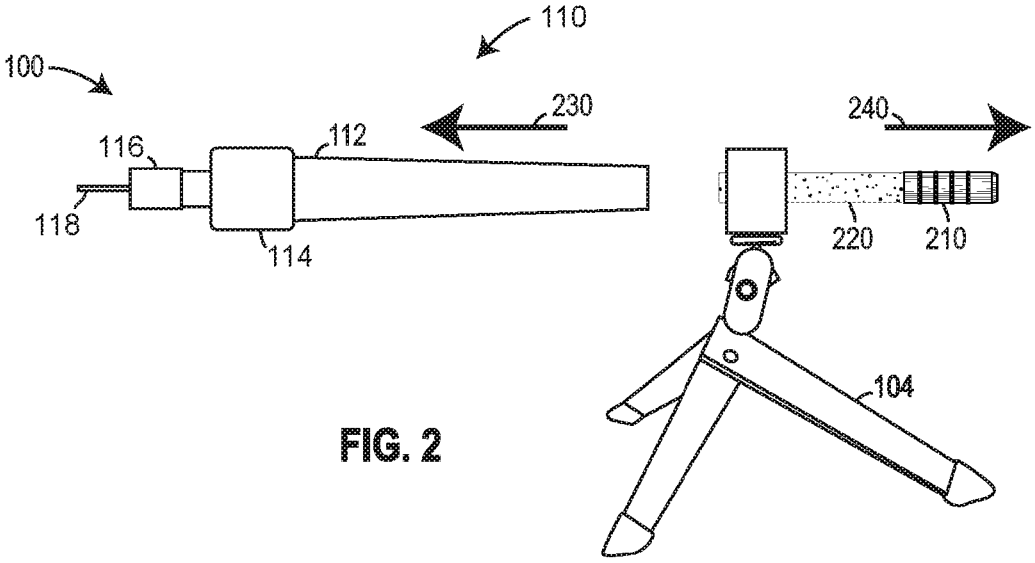
FIG. 2 is a view of the disrupter system of FIG. 1 after firing the disrupter cannon.
Figure 3:
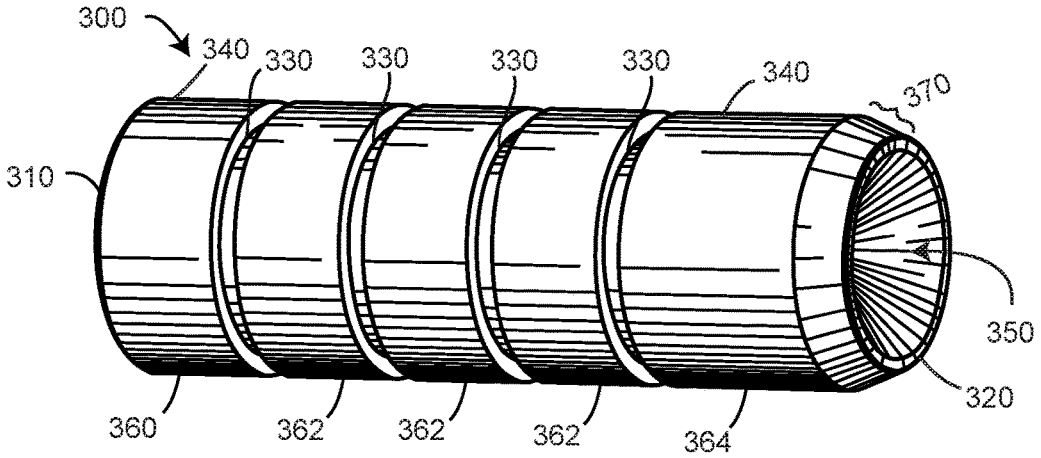
FIG. 3 is a perspective view of a projectile showing the front and side of the projectile without seals according to various aspects of the present disclosure.
Figure 4:
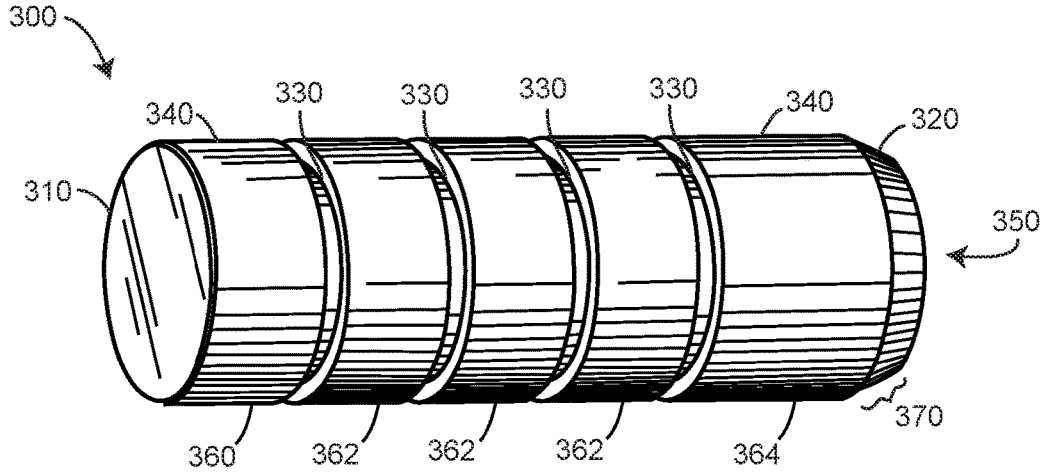
FIG. 4 is a perspective view of the projectile of FIG. 3 showing the rear and side of the projectile without seals.
Figure 5:
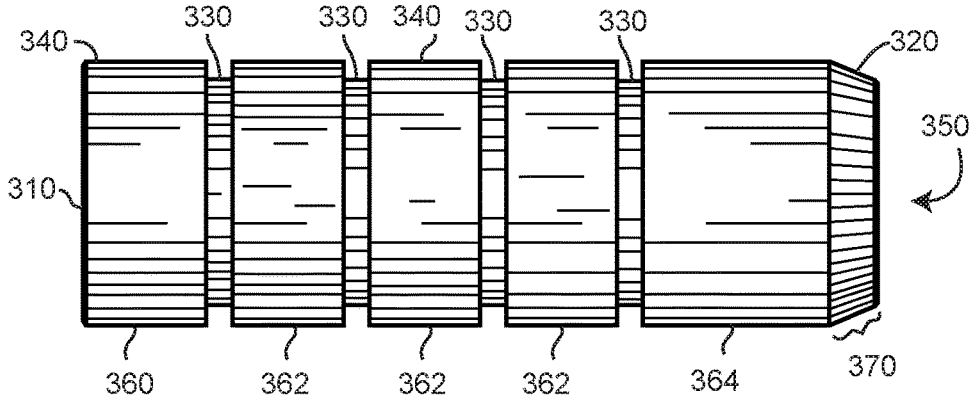
FIG. 5 is a side view of the projectile of FIG. 3 without seals.
Figure 6:
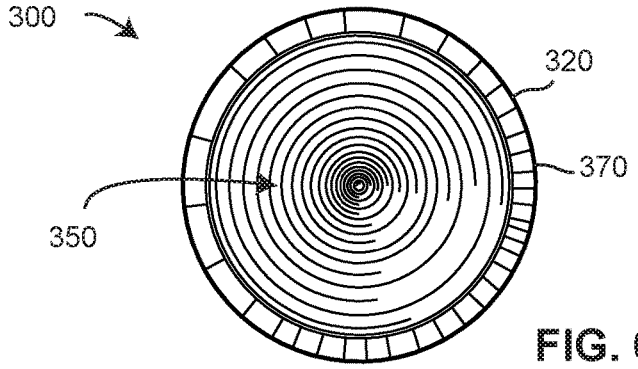
FIG. 6 is a front view of the projectile of FIG. 3 without seals.
Figure 7:
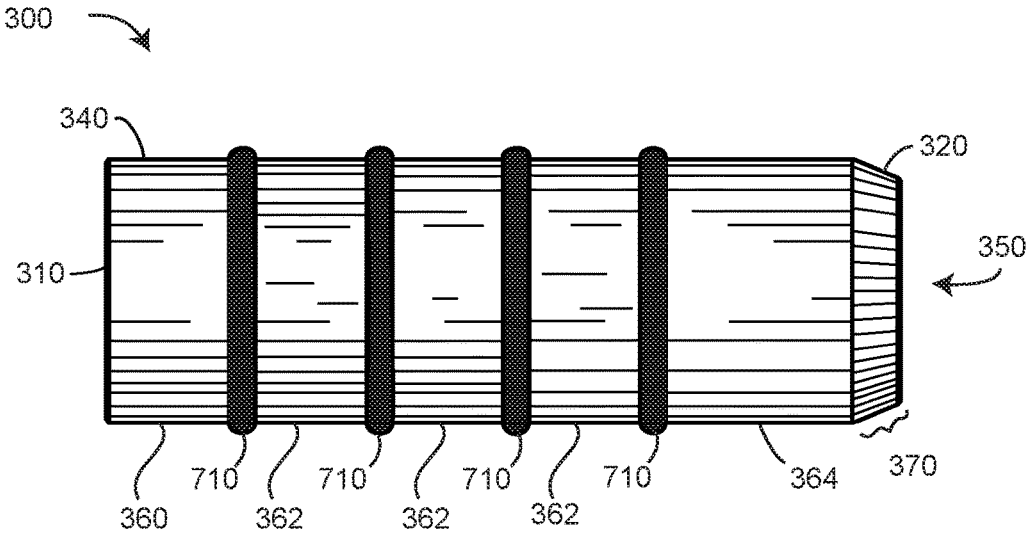
FIG. 7 is a side view of the projectile of FIG. 3 with seals.
Figure 8:
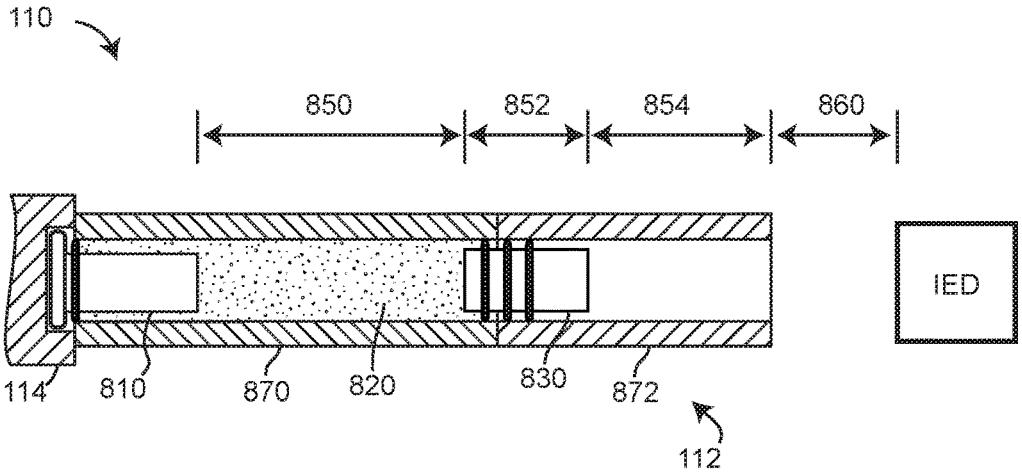
FIG. 8 is a cross section view of a barrel and a portion of a breech of a disrupter cannon.

In an implementation, shown in FIGS. 1-2, disrupter system 100 includes disrupter cannon 110 and mount 104. Disrupter cannon 110 includes barrel 112, breech 114, firing mechanism 116, and shock tube 118.

Barrel 112 may be positioned in mount 104. A barrel includes any disrupter barrel, including barrels formed of steel, titanium, and/or composite materials. A barrel may be of any length. Experiments with launching a combination of water and a projectile have been performed using a barrel having a length of about six (6) inches.

Mount 104 may be positioned on a surface (e.g., earth, ground) proximate to an explosive device. Mount 104 holds disrupter cannon 112 prior to launch. Mount 104 may position disrupter cannon 110 so as to aim (e.g., set trajectory of) disrupter cannon 110 so that projectile 210 launched by disrupter cannon 110 travels an intended trajectory toward the explosive device. Mount 104 may hold disrupter cannon 110 until projectile 210 is launched from disrupter cannon 110.

Firing disrupter cannon 110 launches projectile 210 from barrel 112. Firing a disrupter cannon may be accomplished by igniting a pyrotechnic in a cartridge so that a rapidly expanding gas from the burning pyrotechnic pushes the projectile, and water if any, from barrel 112. Firing disrupter cannon 110 creates a force of recoil that separates disrupter cannon 110 from mount 104. The force of recoil moves disrupter cannon 110 in rearward direction 230 away from mount 104. Firing disrupter cannon 110 launches projectile 210 in forward direction 240 toward a target (e.g., explosive device).

An aerodynamic break (e.g., parachute), not shown, may be attached to disrupter cannon 110 to slow and/or eventually halt movement of disrupter cannon 110 away from mount 104.

As discussed above, disrupter cannon 110 may launch projectile 210. Disrupter cannon 110 may also launch water 220 toward a target. Disrupter cannon 110 launch both projectile 210 and water toward a target. A projectile, water, or the combination thereof may operate to disable and/or destroy an explosive device.

As discussed above, a cartridge may provide the force that launches (e.g., propels) the projectile and/or water from disrupter cannon 110. A cartridge includes a casing and a pyrotechnic inside the casing. Igniting the pyrotechnic provides a rapidly expanding gas. The rapidly expanding gas from the cartridge is directed toward the projectile and/or water in barrel 112 to launch (e.g., propel, push) the projectile and/or water from barrel 112.

A cartridge may include a primer that when activated (e.g., struck) ignites the pyrotechnic. Breech 114 may include a firing pin (not shown). A firing pin may move to strike the primer of a cartridge to ignite the pyrotechnic in the cartridge. Shock tube 118 may provide a force to move a firing pin to strike a primer of a cartridge. Shock tube 118 provides a rapidly expanding gas that applies a force to a firing pin to move the firing pin to strike the primer of a cartridge.

A cartridge may include a seal around the outside of the casing that seals between an outer surface of the casing and an inner surface of the barrel and/or breech. A seal around the casing of a cartridge retains water that is positioned forward of the cartridge so that water positioned in a barrel does not leak from the barrel and/or from the breech. A seal around the casing of the cartridge retains water in a barrel prior to launch. The cartridge may be water proof so that at least a portion (e.g., forward portion) of the cartridge may be surrounded by water without causing the cartridge to malfunction.

A projectile includes an object or collection of objects suitable for launching through a barrel toward a target. A projectile may be a single piece of material or several pieces of material. A projectile may be of any length suitable for launching from a barrel. An implementation of a projectile may have a generally spherical or cylindrical shape. An outer diameter of a spherical or cylindrically shaped projectile is slightly less than the inner diameter of the barrel from which the projectile is launched.

A projectile may include one or more seals. The one or more seals may be positioned around an outer surface of the projectile. A projectile may include one or more channels around a circumference of the projectile to receive a seal. A seal may be positioned in each channel of a projectile. The one or more seals may form a seal between an outer surface of the projectile and an inner surface of the barrel of a disrupter cannon.

A seal may operate to seal water inside a barrel of a disrupter cannon. One or more seals that operate to seal water in a barrel enables the projectile to be positioned in a barrel with water so that the water and projectile may be launched at the same time. The seals of a projectile reduce water loss from the barrel by retaining the water behind the projectile during the time between loading the disrupter cannon with the projectile and water and firing (e.g., launching) the projectile and water from the barrel of the disrupter cannon.

Further, the seals of a projectile retain the water behind (e.g., with respect to the direction of launch) the projectile as a rapidly expanding gas forces the water against the projectile as both the water and the projectile are launched toward a target (e.g., explosive device). Retaining the water behind the projectile increases the amount of force transferred from the water to the projectile to launch the projectile. Retaining the water behind the projectile increases a consistency of operation between firings that use the same amount of water, the same type of projectile, and the same type of cartridge for successive shots.

A seal may operate to retain a rapidly expanding gas provide by a cartridge behind the projectile. A seal between an outer surface of the projectile and an inner surface of the barrel decreases the likelihood that a rapidly expanding gas from a cartridge will pass between the inner surface of the barrel and the outer surface of the projectile. Retaining the rapidly expanding gas behind the projectile increases the amount of force transferred from the rapidly expanding gas to the projectile to launch the projectile. Further, retaining the rapidly expanding gas behind the projectile increases a consistency of operation between firings that use the same type of projectile and the same type of cartridge for successive shots.

A projectile may be formed of a material that reduces the likelihood of generating sparks. As a projectile is launched from a barrel, portions of the projectile may contact an inner surface of the barrel thereby producing a spark. Contact of a projectile with an explosive device, depending on the material of the explosive device, may generate sparks. Generating sparks increases a likelihood of detonating the explosive device. Materials that decrease a likelihood of generating sparks include brass, water, and plastic.

A projectile may include one or more materials that reduce a likelihood of reducing the generation of sparks. A projectile may be formed of any material, but coated with (e.g., encased by, enclosed with) a spark reducing material to reduce the likelihood of generating sparks.

For example, projectile 300 is an implementation of a projectile. Projectile 300 performs the functions of a projectile discussed above, including projectile 210. Projectile 300 includes rear portion 310, forward portion 320, body 340, one or more channel 330, and conical void 350.

Body 340 is shaped to fit into barrel 112 of disrupter cannon 110. The outside diameter of body 340, without seals, is slightly smaller than the inside diameter of barrel 112. Body 340 may be formed of a single piece of material. Sections, such as sections 360, 362, and 364 of body 340 may be formed (e.g., manufactured) of a single piece of material. Sections, such as sections 360, 362, and 364, may be formed separately then assembled to form body 340. Some sections, for example sections 362 may be similar (e.g., length, weight) to each other. The number of similar sections assembled or manufactured to form body 340 may be proportional to a desired weight of projectile 300. Some sections, for example, 360 and 364 may be different from each other and different from section 362 for placement at a particular position on body 340, such as placement of section 360 as rear portion of projectile 300 and placement of section 364 as forward portion of projectile 300. Including more sections 362 increases a weight of projectile 300.

In various implementations, projectile 300 weighs between 2.5 and 5 ounces.

Body 340 may include one or more channels 330. A channel (e.g., groove) receives seal 710. Seal 710 performs the functions of a seal as discussed above. A channel positions a seal. A channel retains a seal in a position relative to body 340 before, during, and/or after launch. A channel provides increased surface area for forming a seal. A channel provides an area for compressing a seal. In an implementation, seal 710 includes an O-ring positioned in a respective channel 330. An O-ring may be formed of butyl rubber.

While projectile 300 is positioned in barrel 112 prior to firing disrupter cannon 110, seal 710 compresses between the outer surfaces of body 340, including the surfaces of channel 330, and an inner surface of barrel 112. Seal 710 forms a seal between the outer surface of body 340, including the surfaces of channel 330, and the inner surface of barrel 112. The seal between body 340 and barrel 112 operates to decrease the passage of water and/or a rapidly expanding gas between the outer surface of body 340 and an inner surface of barrel 112 as discussed above.

A projectile may be shaped to increase its effectiveness at disabling and/or destroying an explosive device. A projectile may be shaped so that at least a portion (e.g., forward portion, nose) of the projectile deforms on impact in a manner to more effectively disable and/or destroy the projectile. A forward portion of a projectile may be shaped to be effective at penetrating and/or separating portions of an explosive device.

For example, forward portion 320 of projectile 300 is formed to have conical void (e.g., cavity) 350 that extends inward into body 340. The shape of forward portion 320 deforms (e.g., bends, is crushed) on impact with an explosive device. On impact, forward portion 320 may deform to conform to a shape of the explosive device at the point of impact. Conforming to the shape of an explosive device may concentrate a force of impact in such a manner as to disable the explosive device. Conforming to a shape of an explosive device may decrease a likelihood that the projectile will graze (e.g., skim) along a surface of the explosive device without penetrating the surface of the explosive device.

For example, firing projectile 300 toward the intersection (e.g., connection) of cap 920 and pipe 940 of pipe bomb 910 causes ridge 370 around conical void 350 to deform on each side of cap 920 so that pipe 940 is punctured at the connection between pipe 940 and cap 920 and force is applied to cap 920. Puncturing pipe 940 and pushing on cap 920 disconnects cap 920 from pipe 940 thereby disabling pipe bomb 910. Projectile 300 may be aimed and fired at either cap 920 or cap 930 to achieve a similar result. Mount 104 may position (e.g., aim) disrupter cannon 110 so that projectile 300 strikes at the junction between pipe 940 and cap 920.

Each type of explosive device may have a location where if struck by the projectile, the likelihood of disabling the explosive device increases. Such locations on explosive device may be referred to as predetermined locations. For example, on pipe bombs, as discussed above, the predetermined location is the junction between the pipe and the cap. For a bomb made of a pipe fitting, the predetermined location is near an edge of the fitting as further discussed below. For a bomb made from a pressure cooker, the predetermined location may be at the lower edge of the lid between lugs. For an explosive device made from an ammunition box, the predetermined location may be just under the hinges.

Rear portion 310 is shaped to have a flat surface for receiving a force provide by a rapidly expanding gas and/or from water moved (e.g., pushed) by a rapidly expanding gas. Rear portion 310 may have any shape.

In an implementation, body 340 is formed, in whole or part, of non-sparking (e.g., does not spark) material such as copper and/or brass to reduce the likelihood that a spark from launching the projectile or the projectile striking the explosive device ignites the explosive device.

In an implementation, projectile 300 includes three sections 362 to provide a mass of projectile 300 (e.g., 4 ounces) that is suitable for the type of explosive device to be disable. In another implementation, projectile 300 includes two sections 362 to provide a suitable mass (e.g., 3.5 ounces). A suitable mass for a projectile is a mass that is sufficient to disable and/or destroy the explosive device when launched from disrupter cannon 110.

A discussed above, a heavier projectile may permit the projectile to be launched at a slower speed, to reduce the likelihood of detonating the explosive device, to disable the explosive device. Muzzle velocity may be categorized into four groups: low velocity, medium velocity, high velocity, and ultra-high velocity. Low muzzle velocity is in the range of 515 feet per second to 1,085 feet per second. Medium muzzle velocity is in the range of 1,086 feet per second to 1,410 feet per second. High muzzle velocity is in the range of 1,411 feet per second to 1,555 feet per second. Ultra-high muzzle velocity is in the range of 1,556 feet per second to 1,765 feet per second. In an implementation, low muzzle velocity is about 800, medium muzzle velocity is about 1,370, high muzzle velocity is about 1,450, and ultra-high muzzle velocity is about 1,660 feet per second.

Muzzle velocity is measured by placing the projectile next to the cartridge in the barrel without water, igniting the cartridge and measuring the velocity of the projectile at the end (e.g., muzzle) of the barrel as the projectile exits the barrel. Because the projectile is positioned proximate to the cartridge, the expanding gas accelerates the projectile to its maximum velocity for that particular type of cartridge.

Cartridges may be categorized according to the muzzle velocity they impart to a projectile. A low velocity cartridge launches a projectile at between 515 and 1,085 feet per second. In an implementation the low velocity cartridge launches the projectile at about 800 feet per second. A medium velocity cartridge launches a projectile at between 1,086 and 1,410 feet per second, or 1,370 feet per second, and so forth for high velocity and ultra-high velocity cartridges.

Figure 9:
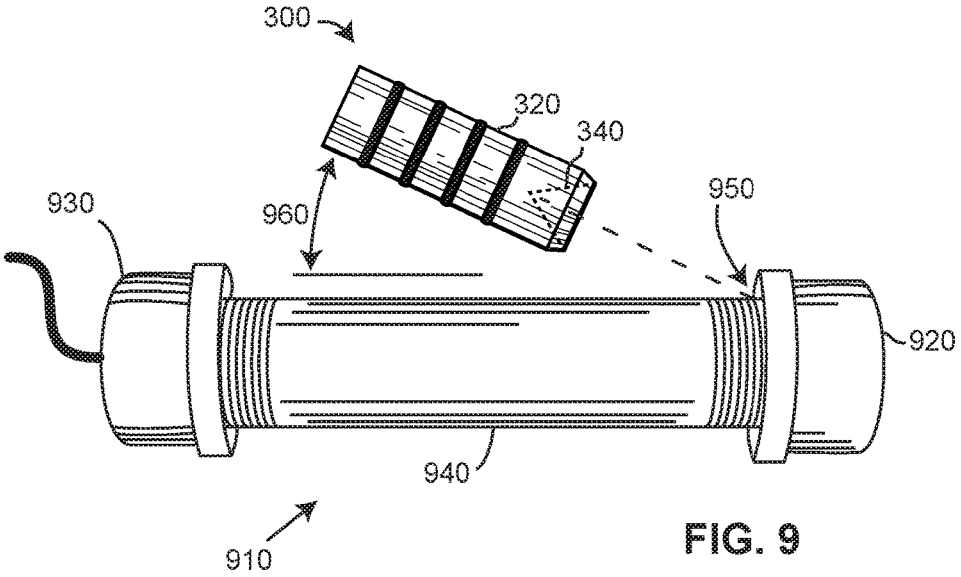
FIGS. 9 and 10 are views of a projectile according to various aspects of the present disclosure in flight toward a pipe bomb.

As discussed above, a disrupter cannon may launch a projectile and water together toward an explosive device to disable and/or destroy the explosive device. For example, FIG. 9 shows a simplified cross-section of disrupter cannon 110. Disrupter cannon 110 has been loaded with cartridge 810, water 820, and projectile 830. A seal on cartridge 810 retains water 820 forward of cartridge 810. The seals on projectile 830 retains water 820 behind projectile 830.

Igniting cartridge 810 causes cartridge 810 to produce a rapidly expanding gas that exerts a force on water 820. Because the compressibility of water is low and the water is constrained by barrel 112, the force applied on water 820 is transferred to projectile 830. The force on water 820 and projectile 830 via water 820 forces (e.g., propels) water 820 and projectile 830 from the muzzle (e.g., forward end) of barrel 112.

The presence of water 820 in barrel 112 shields projectile 830 from the hot, rapidly expanding gases from cartridge 810 thereby limiting the heat transferred from the rapidly expanding gas to projectile 830. Limiting the heat transferred from the rapidly expanding gas to the projectile decreases the increase in temperature that projectile 830 would have experience in the absence of water 820. Limiting the increase in the temperature of projectile 830 before it strikes and explosive device decreases a likelihood of detonating an explosive device.

As projectile 830 is pushed from barrel 112, projectile 830 contacts an inner surface of barrel 112. The contact between projectile 830 and barrel 112 during launch increases the temperature of projectile 830 through friction with barrel 112. However, water 820 limits the increase in temperature of projectile 830 due to friction because water 820 is in contact with projectile 830 and absorbs (e.g., receives) some of the increase in temperature. Water 820 acts to limit the temperature increase in projectile 830 during launch thereby decreasing the likelihood that projectile 830 will detonate the explosive device when it strikes the explosive device.

A result of launching projectile 830 with water 820 is that projectile 830 experiences little or no temperature increase during launch. Because the temperature of projectile 830 does not increase or does not increase very much during launch, the temperature of projectile 830 is about the same as the surrounding environment when it impacts the explosive device. As discussed above, a projectile having a lower temperature is less likely to ignite an explosive device.

At launch, water 820 follows the trajectory of projectile 830. Projectile 830 pierces (e.g., punctures) the housing of the explosive device to make a hole in the housing. Water 820 enters the explosive device through the hole thereby wetting the interior of the explosive device including the explosive material (e.g., gun powder) thereby further decreasing a likelihood that the explosive device will detonate.

Water 820 further decreases the amount of fire (e.g., flames, burning material) from cartridge 810 that exits the muzzle of barrel 112 once projectile 830 and water 020 have exited barrel 112. Decreasing the fire emitted from barrel 112 decreases the likelihood of detonating the explosive device.

The launch characteristics (e.g., muzzle velocity) of a projectile may further be determine by the position of the projectile in the barrel relative to the muzzle of the barrel prior to launch. Because projectile 830 is loaded (e.g., positioned) in barrel 112 by a human operator, the operator may position projectile 830 to increase or decrease the muzzle velocity of projectile 830 and water 820 when it exits the muzzle of barrel 112.

Ignoring the presence of water 820, the expanding gas from cartridge 810 pushes on projectile 830 to launch projectile 830 from barrel 112. For each millisecond that the expanding gas acts on projectile 830, the velocity of projectile 830 increases. Decreasing the amount of time that the expanding gas operates on projectile 830 decreases the muzzle velocity of projectile 830. Increasing the amount of time that the expanding gas operates on projectile 830 increases the muzzle velocity of projectile 830. As projectile 830 exits barrel 112, the expanding gas can no longer operate on projectile 830 to accelerate projectile 830. The relationship between the amount of time that projectile 830 remains in barrel 112 to be acted upon by the expanding gas and the velocity of projectile 830 holds whether or not water is positioned between cartridge 810 and projectile 830.

In operation, decreasing distance 850 between cartridge 810 and projectile 830 increases the muzzle velocity of projectile 830; whereas increasing distance 850 decreases the muzzle velocity of projectile 830.

When water 820 is present between cartridge 810 and projectile 830, the force of the expanding gas from cartridge 810 acts on water 820 which in turn acts on projectile 830 to accelerate projectile 830. However, as soon as projectile 830 exits the barrel, water 820 is no longer able to transfer force to projectile 830 to accelerate projectile 830 because water 820 is no longer constrained by barrel 112. Even though the force of the expanding gas from cartridge 810 continues to act on water 820 after projectile 830 exits barrel 112, water 820 cannot transfer the force to projectile 830, so projectile 830 continues to accelerate until projectile 830 exits barrel 112. Once projectile 830 exits barrel 112, the walls of barrel 112 no longer constrain the outward expansion of water 820, so the diameter of the column of water 820 may expand responsive to the rapidly expanding gas rather than provide force to accelerate projectile 830.

So, even when water 820 is present in barrel 112 between cartridge 810 and projectile 830, the muzzle velocity of projectile 830 is determined by distance 850 which corresponds to an amount of time that the rapidly expanding gas acts on projectile 830 to accelerate the velocity of projectile 830. Distance 850 may also be expressed as the length of barrel 112 minus distance 854. The greater distance 850, the less the amount of time the expanding gas may act on projectile 830 and therefore the less the muzzle velocity of projectile 830.

In the field, positioning projectile 830 distance 850 from cartridge 810 reduces the amount of force that the expanding gas may applied to projectile 830 because projectile 830 travels a distance 852 plus distance 854 before it exits the barrel as opposed to traveling distance 850 plus distance 852 plus distance 854. Distance 854 may be set by a technician while loading disrupter cannon 110 so that the muzzle velocity of projectile 830 is consistent with the type of explosive device being disabled.

In an implementation, barrel 112 includes barrel 870 that attaches to breech 114 and barrel 872 that attaches to barrel 870 to extend the length of barrel 112. A technician may remove barrel 872 from barrel 870, insert projectile 830 at least partially into barrel 870 then couple barrel 872 to barrel 870. Positioning projectile 830 in barrel 870 then coupling barrel 872 to barrel 870 means that the expanding gas will act on projectile 830 for a distance of about the length of barrel 872, which is just less than distance 852 plus distance 854. In an implementation, the length of barrel 872 is about six inches, so the rear of projectile 830 travels slightly more than six inches, between 6.05 and 6.6 inches, before the rear of projectile 830 exits barrel 112.

Regardless of whether barrel 112 is formed of a single piece of material or of multiple pieces that are coupled together, the rearward portion of projectile 830 may be positioned in barrel 112 at any distance in front of cartridge 810 or behind (e.g., rearward of) the muzzle of barrel 112. The distance that the rearward portion of projectile 830 may be positioned rearward of the muzzle of barrel 112 may range from about 4 inches to about 8 inches. For a 6-inch barrel, positioning the rearward portion of projectile 830 4 to 5 inches rearward of the muzzle leaves between 1 and two inches between projectile 830 and cartridge 810. For a 12-inch barrel, positioning the rearward portion of projectile 830 4 to 8 inches rearward of the muzzle leaves between 4 and 8 inches between projectile 830 and cartridge 810.

Exit velocity for a particular cartridge and a particular projectile may be determined empirically. Testing has been conducted for determining distance 852 plus 854 for disabling various types of bombs using projectiles consistent with projectile 300.

Referring to FIG. 9, projectile 300 may be launched from disrupter cannon 110, also referred to as cannon 110, toward pipe bomb 910 to disable pipe bomb 910. Pipe bomb 910 has exposed threads at the intersection of cap 930 pipe 940 and cap 920 and pipe 940. Prior to launch, the muzzle of barrel 112 may be placed about 12 inches (distance 860) from intersection (e.g., joint) 950 between pipe 940 and cap 920. Barrel 112 may be oriented to launch projectile 300 at angle 960 of between 20 and 25 degrees with respect to pipe 940. Disrupter cannon 110 may be positioned to aim the point (e.g., tip) of the cone inside projectile 300 at intersection 950. Aiming the tip of the conical cavity aims a central axis of the projectile toward intersection 950. Projectile 300 may be placed in barrel 112 so that the distance from the rear of projectile 300 to the muzzle (e.g., 852+854) is about six inches. Water may be positioned in barrel 112 between projectile 300 (e.g., 830) and cartridge 810. A high velocity cartridge may be used to launch projectile 300 from barrel 112. A high velocity cartridge will launch projectile 300 from barrel 112 at about 1,450 feet per second; however, because the rear of projectile 300 (830) is not positioned next to cartridge 810, but about six inches away from the muzzle (e.g., 852+854=about 6 inches), water 820 and projectile 300 (830) will exit barrel 112 at a velocity that is less than 1,450 feet per second.

If pipe bomb 910 is positioned on a soft surface, such as mud or snow, an ultra-velocity cartridge may be used to launch projectile 300 (830) to compensate for movement of pipe bomb 910 into the soft surface on impact of projectile 300. An ultra-high velocity cartridge will launch projectile 300 from barrel 112 at about 1,660 feet per second; however, because the rear of projectile 300 (830) is not positioned next to cartridge 810, but about six inches away from the muzzle (e.g., 852+854=about 6 inches), water 820 and projectile 300 (830) will exit barrel 112 at a velocity that is less than 1,660 feet per second.

Experiments have shown that launching a 3.5 ounce projectile similar to projectile 300 (e.g., two sections 362) using the above parameters results in a pipe bomb with external threads being disabled without igniting the pipe bomb.

Figure 10:
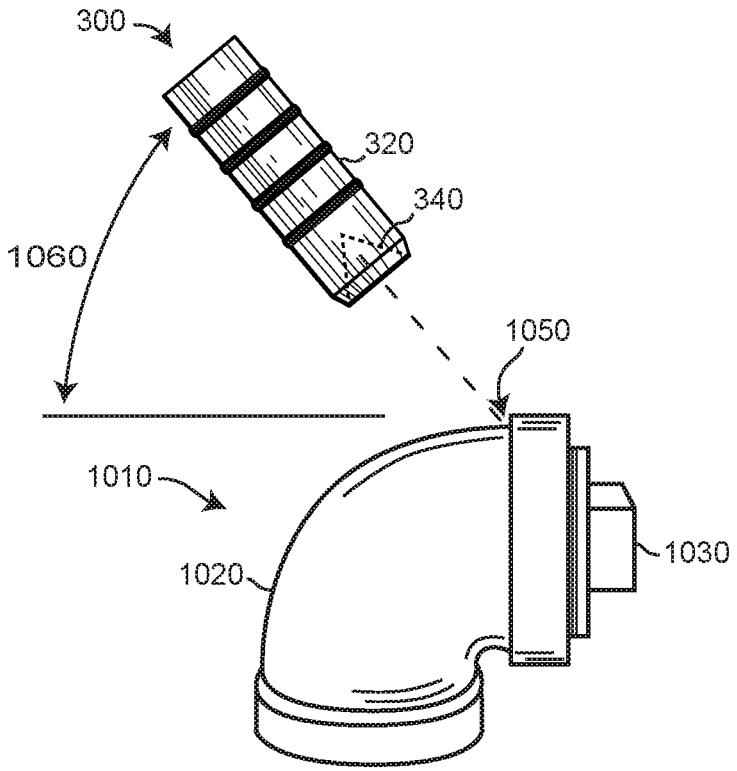

Referring to FIG. 10, projectile 300 may be launched from disrupter cannon 110 toward pipe bomb 1010 to disable pipe bomb 1010. Pipe bomb 1010 is formed from pipe fitting 1020 (e.g., elbow) which is closed with plug 1030 to retain the explosive material inside pipe fitting 1020. The threads that couple pipe fitting 1020, also referred to as fitting 1020, to plug 1030 are positioned primarily inside pipe fitting 1020. Prior to launch, the muzzle of barrel 112 may be placed about 6 inches (distance 860) from point 1050 on pipe fitting 1020. Barrel 112 may be oriented to launch projectile 300 at angle 1060 of between 50 and 55 degrees with respect to pipe fitting 1020. Disrupter cannon 110 may be positioned to aim the point (e.g., tip) of the cone inside projectile 300 at point 1050. Aiming the tip of the conical cavity aims a central axis of the projectile toward point 1050. Projectile 300 may be placed in barrel 112 so that the distance from the rear of projectile 300 (800) to the muzzle (e.g., 852+854) is about six inches. Water may be positioned in barrel 112 between projectile 300 (e.g., 830) and cartridge 810. A high velocity cartridge may be used to launch projectile 300 from barrel 112. A high velocity cartridge will launch projectile 300 from barrel 112 at about 1,450 feet per second; however, because the rear of projectile 300 is not positioned next to cartridge 810, but about six inches away from the muzzle (e.g., 852+854=about 6 inches), water 820 and projectile 300 (830) will exit barrel 112 at a velocity that is less than 1,450 feet per second.

If pipe bomb 1010 is positioned on a soft surface, such as mud or snow, an ultra-velocity cartridge may be used to launch projectile 300 (830) to compensate for movement of pipe bomb 1010 into the soft surface on impact of projectile 300 as discussed above.

Experiments have shown that launching a 4.0 ounce projectile similar to projectile 300 (e.g., three sections 362) using the above parameters results in a pipe bomb with internal threads being disabled without igniting the pipe bomb.

The foregoing description discusses embodiments, which may be changed or modified without departing from the scope of the present disclosure as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments have been described, the scope of the invention is intended to be measured by the claims as set forth below. In the claims, the term "provided" is used to definitively identify an object that not a claimed element but an object that performs the function of a workpiece. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

The location indicators "herein", "hereunder", "above", "below", or other word that refer to a location, whether specific or general, in the specification shall be construed to refer to any location in the specification whether the location is before or after the location indicator.

What is claimed is:

1. A disrupter for disabling a provided explosive device, the disrupter comprising:
- a barrel, the barrel having a muzzle end portion;
- a breech for coupling to the barrel;
- a cartridge for positioning in the barrel forward of the breech, the cartridge includes a first seal;
- a projectile for positioning in the barrel forward of the cartridge, the projectile includes a conical cavity and a second seal;
- an amount of water for positioning in the barrel between the cartridge and the projectile;
- wherein:
- prior to igniting the cartridge:
  - the projectile is positioned in the barrel, a rear portion of the projectile positioned a distance rearward of the muzzle end portion;
  - the amount of water is positioned in the barrel rearward of the projectile;
  - the second seal forms a seal between an outer surface of the projectile and an inner surface of the barrel to retain the amount of water in the barrel rearward of the second seal;
  - the cartridge is positioned at least partially in the barrel rearward of the amount of water;
  - the first seal forms a seal between an outer surface of the cartridge and the inner surface of the barrel to retain the amount of water in the barrel forward of the first seal;
  - the breech is coupled to the barrel rearward of the cartridge; and
  - the barrel is positioned to aim a tip of the conical cavity toward a predetermined location on the explosive device; and
- responsive to igniting the cartridge:
  - a rapidly expanding gas from the cartridge launches the amount of water and the projectile out the barrel toward the explosive device to disable the explosive device.

2. The disrupter of claim 1 wherein the projectile and the amount of water exit the barrel at a velocity of less than 1,450 feet per second.

3. The disrupter of claim 1 wherein the projectile and the amount of water exit the barrel at a velocity of less than 1,660 feet per second.

4. The disrupter of claim 1 wherein the distance is about six inches.

5. The disrupter of claim 1 wherein the distance is between four inches and eight inches.

6. The disrupter of claim 1 wherein decreasing the distance decreases a muzzle velocity of the amount of water and the projectile.

7. The disrupter of claim 1 wherein a side of the conical cavity deforms upon impact with the explosive device.

8. The disrupter of claim 1 wherein the projectile weighs between 3 and 4.5 ounces.

9. A disrupter for disabling a provided explosive device, the disrupter comprising:

a barrel, the barrel having a muzzle end portion;

a cartridge for positioning in the barrel, the cartridge includes a first seal;

a projectile for positioning in the barrel forward of the cartridge, the projectile includes a conical cavity and a second seal;

an amount of water for positioning in the barrel between the cartridge and the projectile; wherein:

prior to igniting the cartridge:

the projectile is positioned in the barrel, a rear portion of the projectile positioned a distance rearward of the muzzle end portion;

the amount of water is positioned in the barrel rearward of the projectile;

the second seal forms a seal between an outer surface of the projectile and an inner surface of the barrel to retain the amount of water in the barrel rearward of the second seal;

the cartridge is positioned at least partially in the barrel rearward of the amount of water;

the first seal forms a seal between an outer surface of the cartridge and the inner surface of the barrel to retain the amount of water in the barrel forward of the first seal;

the barrel is positioned to aim a tip of the conical cavity toward a predetermined location on the explosive device; and responsive to igniting the cartridge:

a rapidly expanding gas from the cartridge launches the amount of water and the projectile out the barrel toward the explosive device to disable the explosive device.

10. The disrupter of claim 9 wherein the projectile and the amount of water exit the barrel at a velocity of less than 1,450 feet per second.

11. The disrupter of claim 9 wherein the projectile and the amount of water exit the barrel at a velocity of less than 1,660 feet per second.

12. The disrupter of claim 9 wherein the distance is about six inches.

13. The disrupter of claim 9 wherein the distance is between four inches and eight inches.

14. The disrupter of claim 9 wherein a side of the conical cavity deforms upon impact with the explosive device.

15. The disrupter of claim 9 wherein the projectile weighs between 3 and 4.5 ounces.

* * * * *